US006230428B1

(12) United States Patent
Albin

(10) Patent No.: US 6,230,428 B1
(45) Date of Patent: May 15, 2001

(54) PICTURE FRAME CONNECTOR

(76) Inventor: Stephen D. Albin, 610 Rancho, Los Altos, CA (US) 94024

( * ) Notice: Subject to any disclaimer, the term of this patent is extended or adjusted under 35 U.S.C. 154(b) by 0 days.

(21) Appl. No.: 08/744,705

(22) Filed: Oct. 31, 1996

Related U.S. Application Data

(60) Provisional application No. 60/012,610, filed on Mar. 1, 1996.

(51) Int. Cl.[7] ..... A47G 1/06

(52) U.S. Cl. ..... 40/730; 40/605; 40/729; 40/733

(58) Field of Search ..... 16/226; 40/605, 40/729, 730, 733, 779; 403/83, 291

(56) References Cited

U.S. PATENT DOCUMENTS

| | | | | |
|---|---|---|---|---|
| Re. 456 | * | 4/1857 | Critchlow | 40/779 |
| 304,652 | * | 9/1884 | Jory | 40/603 |
| 494,988 | * | 4/1893 | Libbey | 16/226 |
| 1,254,162 | * | 1/1918 | Schroder | 40/729 |
| 2,455,465 | * | 12/1948 | Blumstein | 403/291 |
| 2,483,304 | * | 9/1949 | Vogel | 16/266 X |
| 2,590,744 | * | 3/1952 | Woodbury | 40/733 |
| 2,806,668 | * | 9/1957 | Hewes | 403/291 X |
| 2,892,050 | * | 6/1959 | Fisher | 16/226 X |
| 3,523,382 | * | 8/1970 | Dreyer | 40/605 X |
| 3,529,374 | * | 9/1970 | Spertus | 40/730 |
| 3,565,382 | * | 2/1971 | Passarelli, Jr. | 248/300 |
| 3,783,543 | * | 1/1974 | Hemgren | 40/649 X |
| 4,115,938 | * | 9/1978 | Belmuth et al. | 40/730 |
| 4,551,882 | * | 11/1985 | Swersey et al. | 16/226 |
| 4,578,886 | * | 4/1986 | Lofredo | 40/730 X |
| 4,619,304 | * | 10/1986 | Smith | 16/226 X |
| 4,878,266 | * | 11/1989 | Cubides | 16/226 X |
| 5,283,967 | * | 2/1994 | Abrams | 40/779 |

* cited by examiner

*Primary Examiner*—Terry Lee Melius
*Assistant Examiner*—Andrea Chop
(74) *Attorney, Agent, or Firm*—Beyer Weaver & Thomas, LLP

(57) ABSTRACT

A frame connector for quickly and easily attaching two picture frames together in a stable manner has a support arm and a coupling member on each end. A coupling member may be a slider, snap, wedge or spring. A slider frame support attaches easily to either metal or wood frames. A coupling member for a slider frame support may be a flat piece for screwing or nailing to a wood frame, or may be slid into the channel of a metal frame. Holes, slots or spikes for attaching to a wood frame may be incorporated into any of the coupling members. A slider frame support includes a screw hole for a screw that secures the slider support to a channel of a metal frame. A snap frame support attaches to a channel of a frame by fingers that snap into the channel. A wedge frame support secures itself in a channel of a frame by wedging itself within the channel. A spring frame support secures itself in the channel of a frame by spring-like fingers that press against the channel walls. The support arm for any of the coupling members may be a rigid arm that is easily bent to a desired position, or may be a hinge.

13 Claims, 14 Drawing Sheets

PICTURE FRAME CONNECTOR

This application claims the benefit of U.S. Provisional Application No. 60/012,610, filed Mar. 1, 1996.

FIELD OF THE INVENTION

The present invention relates generally to connectors and specifically to a support system for connecting picture frames.

BACKGROUND OF THE INVENTION

There are a wide variety of devices that are conventionally used to frame pictures, drawings, diplomas and a variety of other objects. The term "picture frame" is typically used when referring to these devices. Picture frames take a wide variety of forms including metal frames, wooden frames, plastic frames, mount boards, picture mats, plaques, etc. In the description herein, the term picture frame is intended to cover all of these forms. Such picture frames come in a wide variety of shapes, colors and materials. Common materials for frames are either wood or metal.

Often it is desirable to hang the picture frame on a wall. It is also often desirable to combine more than one picture frame together which allow the picture frames to stand freely. For example, it is often desirable to connect picture frames together in order to stand them together on a desk, shelf, etc. It may be desirable to stand picture frames together in a parallel or "V" form, or it may be desirable to stand the top edges of two frames together to form an "A-frame" type structure. Traditional frame supports include the following: Easels, which hold a picture frame to a desired vertical angle; corner supports, which hold all frame sections together; and frame strap supports which support long sections of molding and keep it from bowing. A possible frame support for freely standing two picture frames together is a standard swivel hinge (such as a type found on doors).

However, the use of a standard swivel hinge on a wooden picture frame has numerous disadvantages in certain situations which is why a typical framing shop is reluctant to attempt to connect picture frames by using a swivel hinge. The use of two swivel hinges (attached to the upper and lower portions of the frames) to connect two picture frames may form a sturdy connection, yet it is difficult to attach two swivel hinges such that they are aligned perfectly and the two frames swing freely. An analogous problem is the hanging of a door by two swivel hinges to a door frame of a house; any carpenter will agree that hanging a door by two swivel hinges is a difficult and time-consuming process. The difficulties are compounded with swivel hinges on picture frames because the frames are very narrow and the swivel hinges themselves can be quite small—down to ¾" of an inch in length or less. Thus, the use of two swivel hinges to connect picture frames is not a common procedure in a picture framing shop, and is even less desirable to be practiced by a layman.

The use of a single swivel hinge to connect two picture frames may be easier than using two hinges, yet it is still fraught with problems. For example, a single, small swivel hinge may be too small to support the weight of larger frames. And as discussed above, the use of two or more swivel hinges is undesirable. Also, larger swivel hinges may not be used in all cases because the sides of the picture frames to which the swivel hinges attach are very narrow. Only small hinges fit the narrow frames.

Swivel hinges may be attached to the backs of picture frames to allow the two frames to bend backward together (away from a viewer, with the point of a "V" shape facing the viewer). The hinges may be attached by laying the two frames face down and attaching the hinge. However, this arrangement only allows the frames to bend in a backward direction. Also, the standard swivel hinge is free to swing back and forth, thus providing a non-stable support. Also, when a user has bent the hinge to a desired position, and then picks up the frames, the positioning is lost because the hinge swings freely. Thus, attaching a standard hinge to the backs of frames has disadvantages.

Attaching standard hinges to the sides of pictures frames also has disadvantages. A hinge may be attached to the sides of two picture frames to allows the frames to swing forward together (toward a viewer, with the point of a "V" shape facing away from the viewer). However, attaching a hinge to the sides of frames is not an easy task. First, the frames must be placed face to face so that their two sides are adjacent and facing upwards. In this position, with the two frames resting on opposite sides, a framer must attach a hinge to the two sides. This is an awkward position from which to attach a hinge because the frames are in an unstable position.

Also, in either case of attaching a standard hinge to the backs or sides of two picture frames it must be mounted in exact alignment. If the hinge is mounted off center, or slightly off of level, then the frames will not stand correctly on a desk or shelf. To correct this, a hinge must be remounted. This process of mounting a standard hinge very carefully in a level orientation or of remounting a standard hinge can be an aggravating and time consuming task.

At times, a double hinge may be used to connect two picture frames, but this double hinge is more difficult to mount than a basic swivel hinge. Also, a double hinge is more expensive than a basic swivel hinge. For these reasons, picture framing shops and laymen are less prone to use a double hinge.

In addition, the use of standard hinges that move freely does not allow frames to be easily stood on a desk in a back to back presentation or "A-frame" presentation. For example, often it is desirable to stand two picture frames back-to-back on a desk with the two pictures facing outward. By spreading the bottom edges of the frames apart the two frames may support themselves by being joined at the top edge by a swivel hinge. However, because a swivel hinge moves freely, this "A-frame" structure may collapse easily. Or, if the frames are picked up or moved, the distance between the two frames may be changed from what the individual had original desired, and the frames must be adjusted again. Thus, a freely movable swivel hinge has disadvantages for an "A-frame" type presentation.

Concerning the connection of metal picture frames, the options for connecting two frames are extremely limited. Typically, two metal frames are joined by permanently soldering a hinge to the metal frames. These frames may be bought in this fashion. Not only is this soldering process difficult and costly, it is not a technique that may be practiced by an average picture framing shop or by the layman. Also, the hinge may not be moved to another portion of the frame, such as to the top. Currently, no off-the-shelf easily mountable hinges are obtainable for connecting two metal frames. For wooden frames in particular, it can be inconvenient to completely unscrew and remove screws or nails from a frame in order to remove or adjust a hinge.

Although there are various picture frame support mechanisms available on the market, there is an ongoing need for improved support arrangements. Accordingly, it is an object of the present invention to provide an improved picture support system. It would be desirable to have an inexpensive, simple connecting device that enables two or more picture frames to be quickly and easily connected in a variety of manners. It would further be desirable for such a connecting device to be usable on either wood or metal frames, and for the device to allow frames to be bent freely in a variety of directions while retaining stability.

SUMMARY OF THE INVENTION

An embodiment of the present invention provides a frame connector for quickly and easily attaching two picture frames together in a stable manner. In one embodiment, a slider frame support is able to attach easily to either metal or wood frames. In other embodiments, a coupling member for wood frames includes nail or screw holes, or spikes. A slider frame support includes a screw hole for a screw that secures the slider support to a channel of a frame.

In another embodiment, a snap frame support attaches to a channel of a frame by fingers that snap into the channel. In another aspect, a wedge frame support secures itself in a channel of a frame by wedging itself within the channel. Another spring frame support secures itself in the channel of a frame by spring-like fingers that press against the channel walls. In other embodiments, the support arm for any of the coupling members may be a rigid arm that is easily bent to a desired position, or may be a hinge.

By providing a variety of coupling members, the present invention is able to be quickly and easily attached to a variety of frame materials and types. Also, through the use of a rigid yet malleable support arm, the present invention provides a stable, yet adjustable frame support. Furthermore, if the frame support is mounted slightly off of level, or at an angle in relation to the frames, it is self-remedying. That is, because the frame support is rigid, yet malleable, any slight error in mounting it may be corrected by simply bending the frame support to the desired position. A time-consuming process of mounting the frame support exactly level or of remounting it is not required as with past standard swivel hinges.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

The present invention provides a rigid yet malleable picture frame support that is easily attachable to a variety of picture frame types, including common wood frames and metal channel frames and back loader frames. The picture frame support is easily adjustable to bend picture frames both inward and outward. Only one support is needed, obviating the need to attach two or more hinges. Also, the picture frame support may be used to attach multiple frames together in a variety of shapes, and may also be used to attach two frames easily in an "A-frame" shape.

In one aspect of the invention, a support arm has a coupling member at each end. The coupling member includes a slider having a threaded hole extending therethrough, and a threaded stud arranged to engage the threaded hole. The slider is sized appropriately to fit within the channel of a metal picture frame. The elongated support arm extends horizontally and connects the sliders. With this arrangement, when the sliders are placed within the picture frame channels, the studs may be screwed into the threaded holes to engage a web portion of the channel and press the slider against the internal edges of the support rail to firmly hold the sliders in place. At the same time, the support arm extends horizontally away from the frame channels to support the frames.

Also, the slider can be used in conjunction with standard wooden frames. Specifically, the slider can be nailed, stapled, screwed, glued or pinned to the back of a wooden frame by using suitable fasteners. The fasteners can be inserted through the threaded holes or smaller openings. In another aspect, the coupling members can incorporate small projections that when snapped into the back of the channel of a metal picture frame couple the support arm to the frame. In another embodiment, the coupling is designed with an arc or wedge which allows the coupling to sit securely in place when slid into the channel of a metal picture frame. The pressure from the coupling engages both lips of the channel, securing the coupling in place. In another embodiment, the coupling is a spike based coupling that allows the coupling to be driven into a wooden frame or the like to couple the support arm arrangement to the frame. In another embodiment, the coupling incorporates spring-like fingers that engage the channel of a metal picture frame from the base of the trough to the lips of the trough and secure the coupling in place by the force of the fingers.

Figure 1:
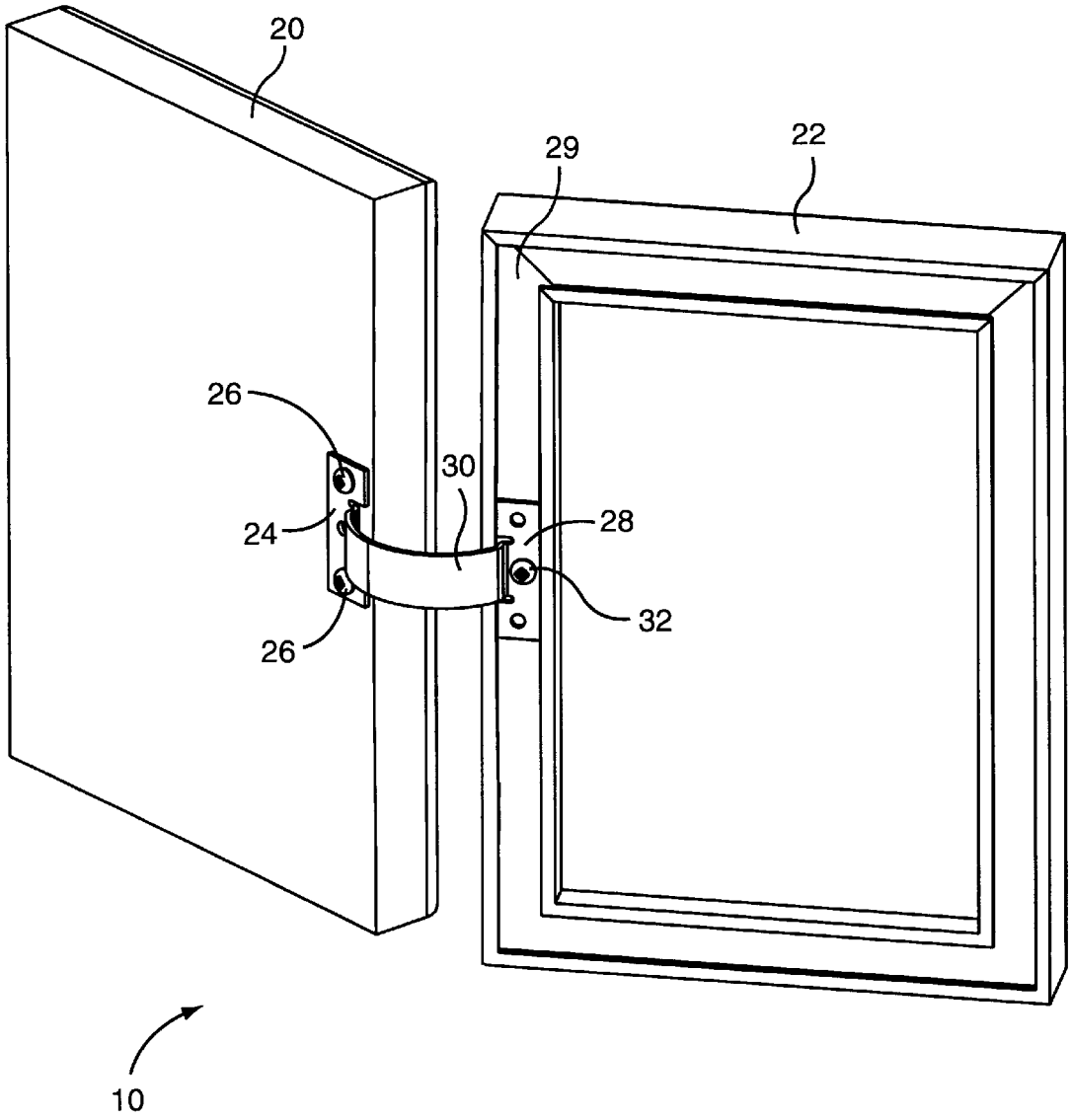
FIG. 1 is a diagrammatic back perspective view of a conventional channel backed metal picture frame and a wood picture frame that utilize a frame support in accordance with one aspect of the present invention.

Referring initially to FIG. 1, a preferred embodiment 10 of a support arm arrangement will be described. As seen therein, a frame support 30 is attached to picture frames 20 and 22. Picture frame 20 is a wooden or similar frame and picture frame 22 is a metal frame with a conventional channel 29. In the embodiment shown, the frame support 30 takes the form of a slider frame support. The slider frame support 30 is shown in more detail in FIG. 2*a*.

In this embodiment, coupling member 24 of the support arm 30 is attached to wooden frame 20 by way of screws 26. Screws 26 pass through holes in the coupling member 24. The coupling member 24 may also be attached to a wooden frame by nails, tacks, spikes, bolts, glue or other adhesive, etc. Coupling member 28 of the support arm 30 is attached to metal frame 22 by being secured within the channel 29 of the frame 22. A detailed cross-section of this channel 29 is shown in FIG. 2*b*. Screw 32 is used to secure the coupling member 28 to the frame 22. When screw 32 is tightened, the bottom of the screw is forced against the base of the channel, thus forcing coupling member 28 up against the inside lips of the channel and securing the coupling member 28 in the channel.

Coupling member 28 is sized so that it is not forced out of the channel when screw 32 is tightened. Instead of a screw 32, any suitable bolt or the like may be used to secure the coupling member to the channel. The coupling member may also be secured to the channel by way of adhesive, being oversized, attachment of a sponge-like substance to its underside, use of springs, etc., or any other similar technique for forcing the coupling member into contact with the channel. Preferably, coupling member 28 is rectangular in shape, and is of such a size so that it may be slid into the channel 29 at an angle, without the need for disassembling the metal frame 22. In this fashion, the support arm is quickly and easily attached to a metal frame. Alternatively, coupling member 28 may be square in shape, may be circular or oval, or may be of any shape that permits its easy entry into the channel 29 yet still has a diameter large enough to prevent it from being forced out of the channel when screw 32 is tightened.

As seen in FIG. 1, in one embodiment a frame support 30 has coupling members of a shape suitable for insertion into a channel of a metal frame, along with a screw hole for a screw 32. Also, each coupling member has holes for attaching the frame support to a wooden frame by screws 26. In this fashion, a frame support 30 may be used with either metal or wooden frames, and may even attach a metal frame to a wooden frame. This versatility of the frame support is advantageous.

Figure 2A:
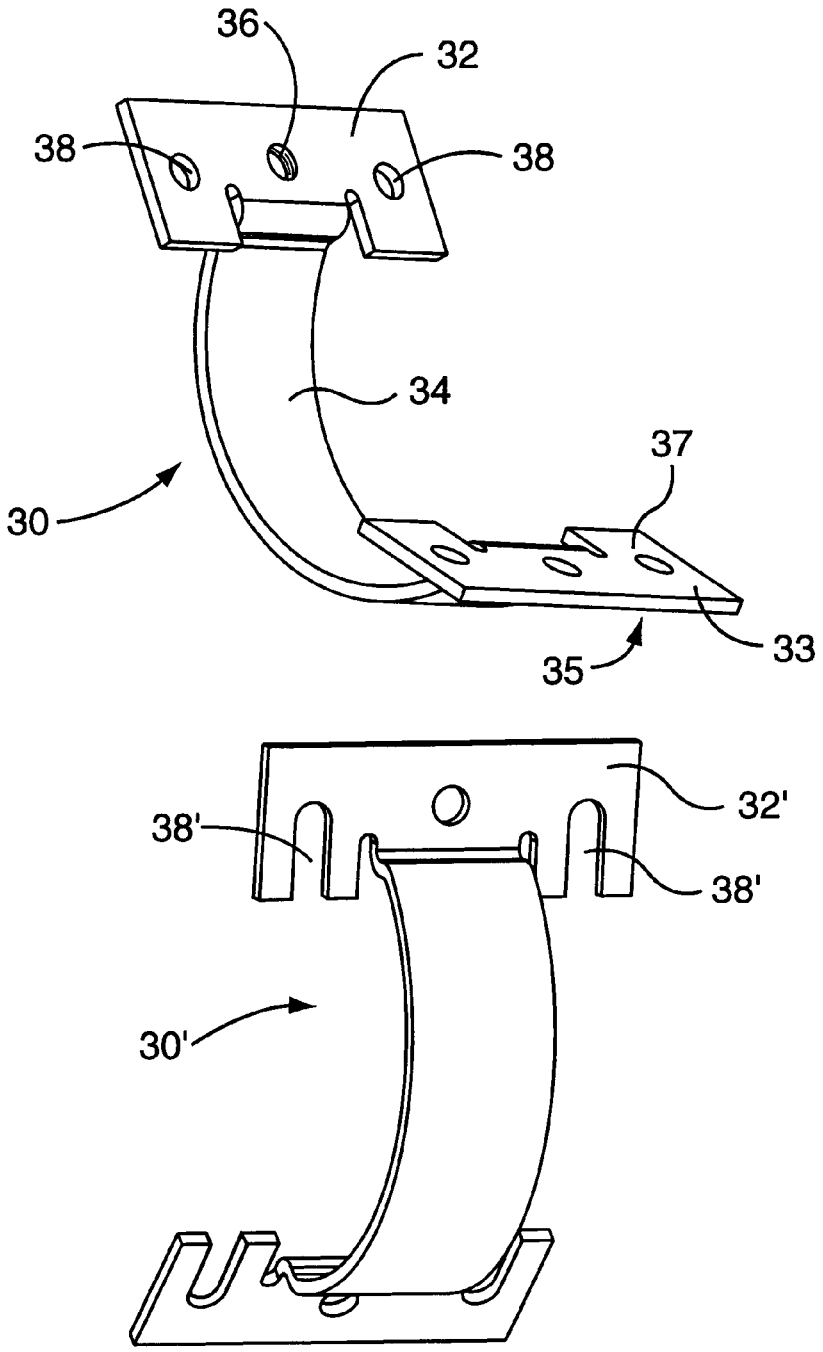
FIG. 2*a* shows two diagrammatic views of a slider support member in accordance with one embodiment of the present invention.
Figure 2B:
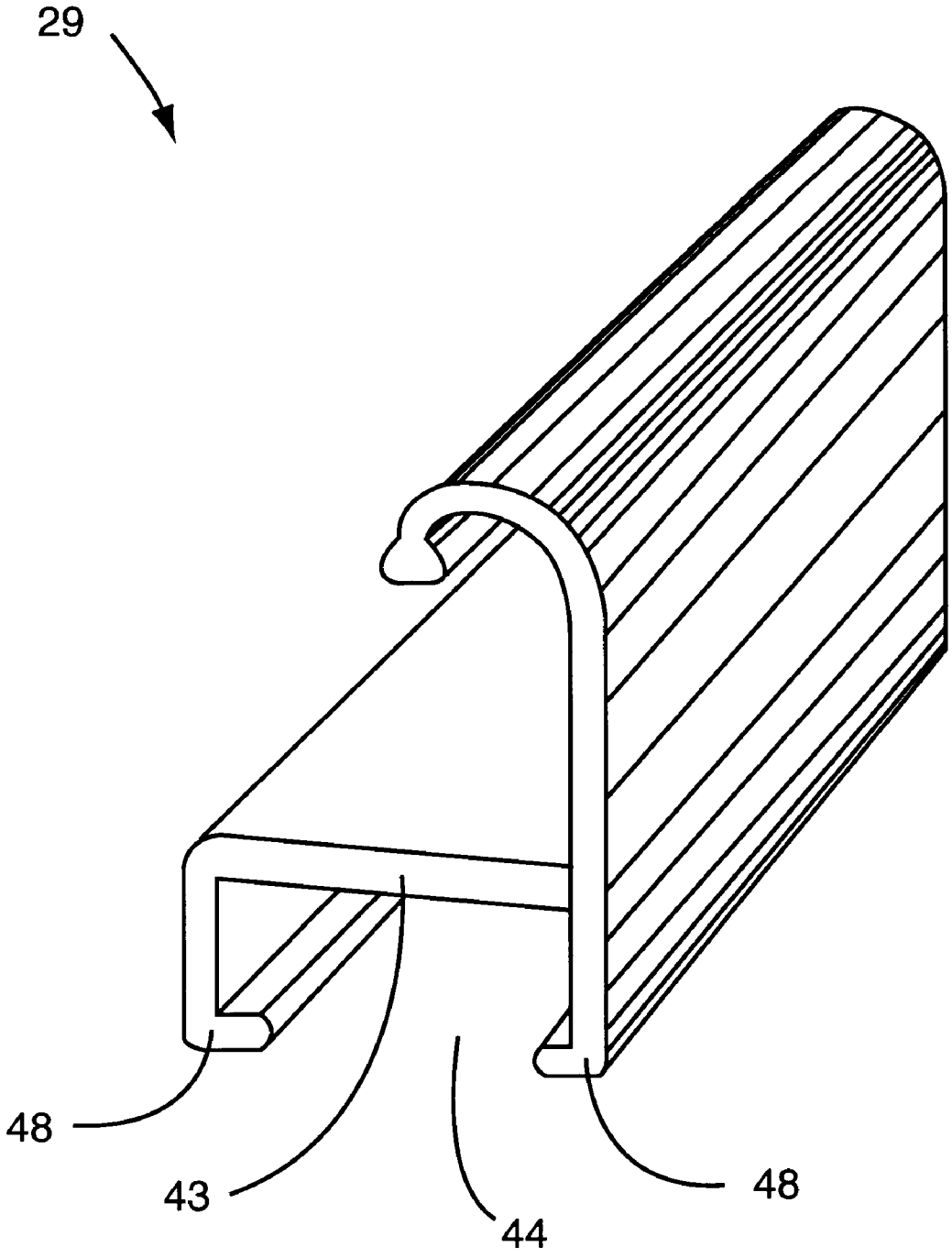
FIG. 2*b* is a diagrammatic end view of a conventional metal picture frame channel.

Referring next to FIG. 2*a*, the slider frame support 30 in accordance with one embodiment of the invention will be described in more detail. The slider frame support 30 includes two slider members 32 and 33 and the support arm 34 which extends transversely from each slider member connecting both members. The arm 34 may also extend between the members in a direction other than transverse. Each of the sliders 32 and 33 has one threaded hole 36 for receiving a screw 32. A plurality of smaller openings 38 are also provided at appropriate positions about each slider member. The openings 38 may receive fasteners such as small diameter nails, tacks or staples in order to fasten the sliders to wood frames. The threaded holes 36 are arranged to receive threaded studs or screws that are used to attach the sliders to a channel type support rail of a metal frame.

The appropriate dimensions for the slider arm support 30 will vary widely in accordance with the type and size of picture frame that is intended to be used. By way of example, a suitable length for the slider members 32 and 33 is approximately one and a quarter inches, a suitable width is on the order of just under a half inch. The length of the arm support 34 may also be varied a great deal. By way of example, a length of approximately one and a quarter inch has been found to work well for most conventional sized picture frames.

The sliders 32, 33 and the support arm 34 are preferably integrally formed. By way of example, the slider arm support 30 may be formed from a suitable metallic material such as steel. The slider arm support 30 may be coated with a protective coating to reduce its abrasive properties and improve its appearance. One advantage of metallic material is that when sized appropriately, the frame support may be bent somewhat and still retain its strength. This is an advantage so the user can adjust the angle at which the picture frame will rest when it is sitting in a free standing position.

It should be appreciated that the described slider frame support may be used with conventional picture frames such as with the picture frames 20 and 22 shown in FIG. 1. Metal frames that include an integrally formed rail arrangement are known to the prior art. One standard size is the ⅝ inch wide rail with a ⅜ inch wide opening to the rails channel. Accordingly, the described slider frame support 30 can be attached to standard metal frames 20 in the manner described with reference to FIG. 1 and to FIG. 2*b*.

It should be apparent that the described slider arm support 30 can also be used in conjunction with a standard wooden frame 22 as in FIG. 1. Specifically, the slider can be nailed, stapled, screwed, glued or pinned to the back of a wooden frame 22 by using suitable fasteners. Or the slider may be rigidly attached using other techniques. The fasteners can be inserted through the threaded holes 36 or through the smaller openings 38. It should be also appreciated that a frame support could join two metal frames, two wood frames or a metal and a wood frame. A number of frame supports may also be used to attach in a linked form any number of picture frames of any materials.

In one embodiment, a frame support 30' takes the form as shown in FIG. 2*a*. In this embodiment, frame support 30' has a slider member (or members) 32' with slots 38' instead of holes 38. A slot 38' is advantageous because a fastener such as a screw or nail need not be completely removed from a wood frame in order to detach the frame support 30'. The screw or nail fastener need only be loosened such that the frame support can be slid out from underneath the head of the screw or nail.

Referring next to FIG. 2*b*, attaching the slider frame support to a metal frame is described. Shown in FIG. 2*b* is a cross-section of a metal picture frame support rail 29. When used in cooperation with a standard metal picture frame support rail 29, the slider member 32 of the slider frame support 30 may be inserted into the rail's channel trough 44. The channel trough has inward confining lips 48, so as to form an undercut channel opening. Preferably, the slider member 32 is of such a size and shape such that it may be inserted into the channel by angling it in one direction, rather than by disassembling the metal frame and sliding the slider member straight into the open end of the channel.

First, the slider member 32 of the frame support 30 is positioned within the trough 44 of the rail 29. The slider member 32 of FIG. 2*a* has a top surface 35 and a bottom surface 37. A threaded stud 32 (as shown in FIG. 1) is screwed into the threaded hole 36 until it contacts the inner surface of web 43. The stud is further turned until the top surface 35 of the slider member is pressed into engagement with the channel lips 48. With the stud 40 tightened firmly, the slider frame support 30 will be firmly secured to rail 29 which in turns provides a solid support for picture frames.

Figure 3:
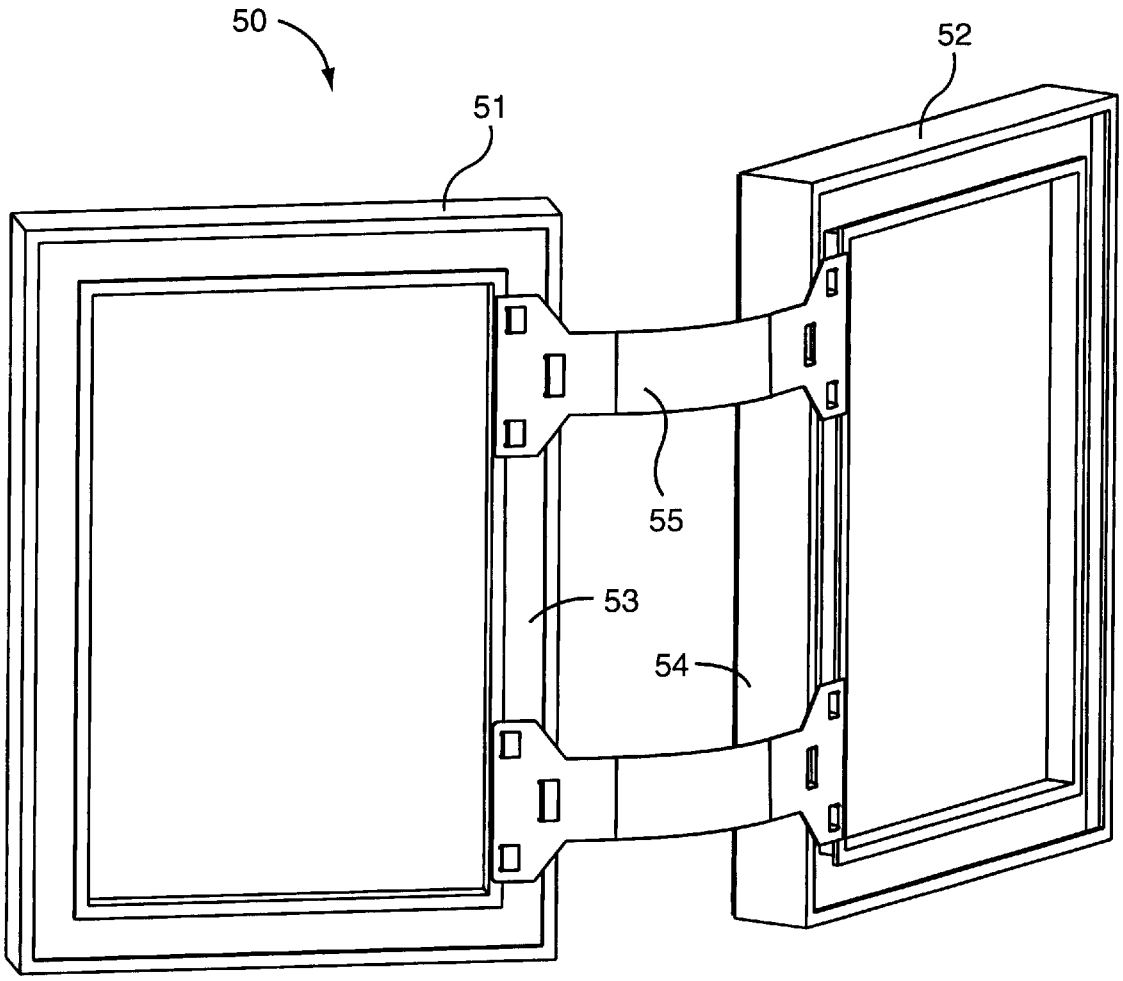
FIG. 3 is a diagrammatic back perspective view of a conventional channel backed metal picture frame that utilizes a snap support member in accordance with one aspect of the present invention.
Figure 4B:
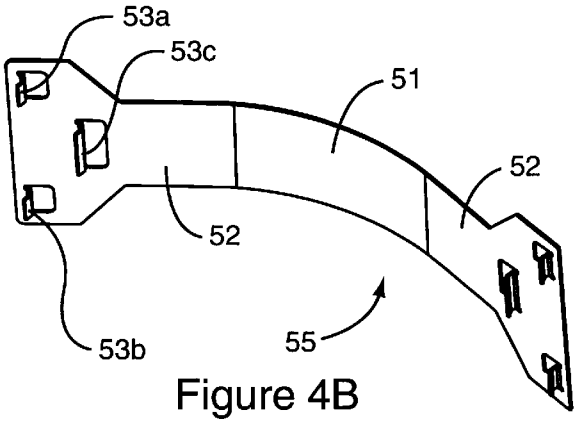
FIGS. 4*a*, 4*b*, 4*c* and 4*d* are diagrammatic top, side and end views of a snap support member in accordance with one embodiment of the present invention.
Figure 4D:
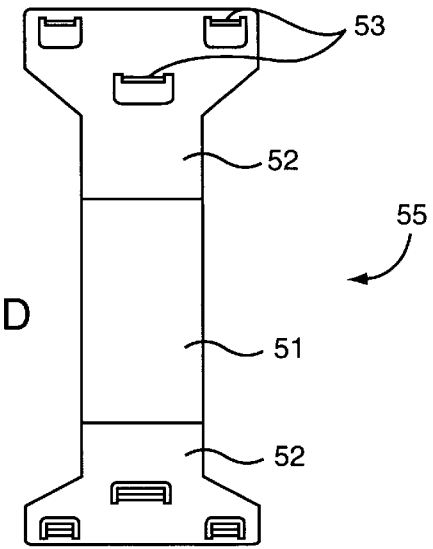
Figure 4A:
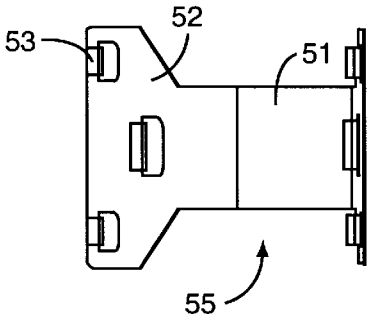
Figure 4C:
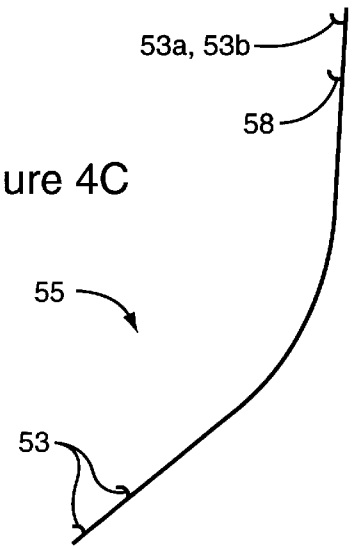

Referring next to FIGS. 3 and 4*a*–4*d*, an alternative frame support arrangement 50 is illustrated. In this embodiment the slider member based coupling mechanism (as illustrated in FIGS. 1 and 2*a*) is replaced by a snap based coupling mechanism 55. FIG. 3 shows a snap frame support 55 connecting a picture frame 51 and a picture frame 52. The snap frame support 55 connects the two frames by way of their respective channels 53 and 54. Preferably, the support arm itself is made of a metallic substance that is malleable such that the arm may be bent and retain its shape.

Referring now to FIGS. 4*a*, 4*b*, 4*c*, 4*d*, this snap frame support 55 is described. The snap frame support 55 includes a support arm 51 which extends transversely from each coupling member 52. The support arm 51 may also attach at any angle to each coupling member 52. Each coupling member 52 has fingers 53 that may be snapped into a metal channel frame or the like to couple the snap frame support arrangement to the frames. For example, as shown best in FIG. 4*b* and 4*c*, fingers 53*a*, 53*b* and 53*c* are curved in one direction. Thus, when inserted into a channel of a metal picture frame, the forward edges 57 of fingers 53*a* and 53*b* make contact with one lip of the channel, while the rear edge 58 of finger 53*c* makes contact with the other lip of the channel, snaps into place and secures the snap frame support 55 to that channel of a metal picture frame.

The actual geometry, size and spacing of each coupling member 52, the support arm 51 and the fingers 53 may be widely varied depending upon the size and form of the channel of the metal frame. The snap frame support 55 may be formed from any suitable material. By way of example, metal has been found to work well. Similarly, when metal or other hard materials are used, the support arm may be coated with a protective coating to reduce its abrasive properties and to improve its appearance.

Figure 5A:
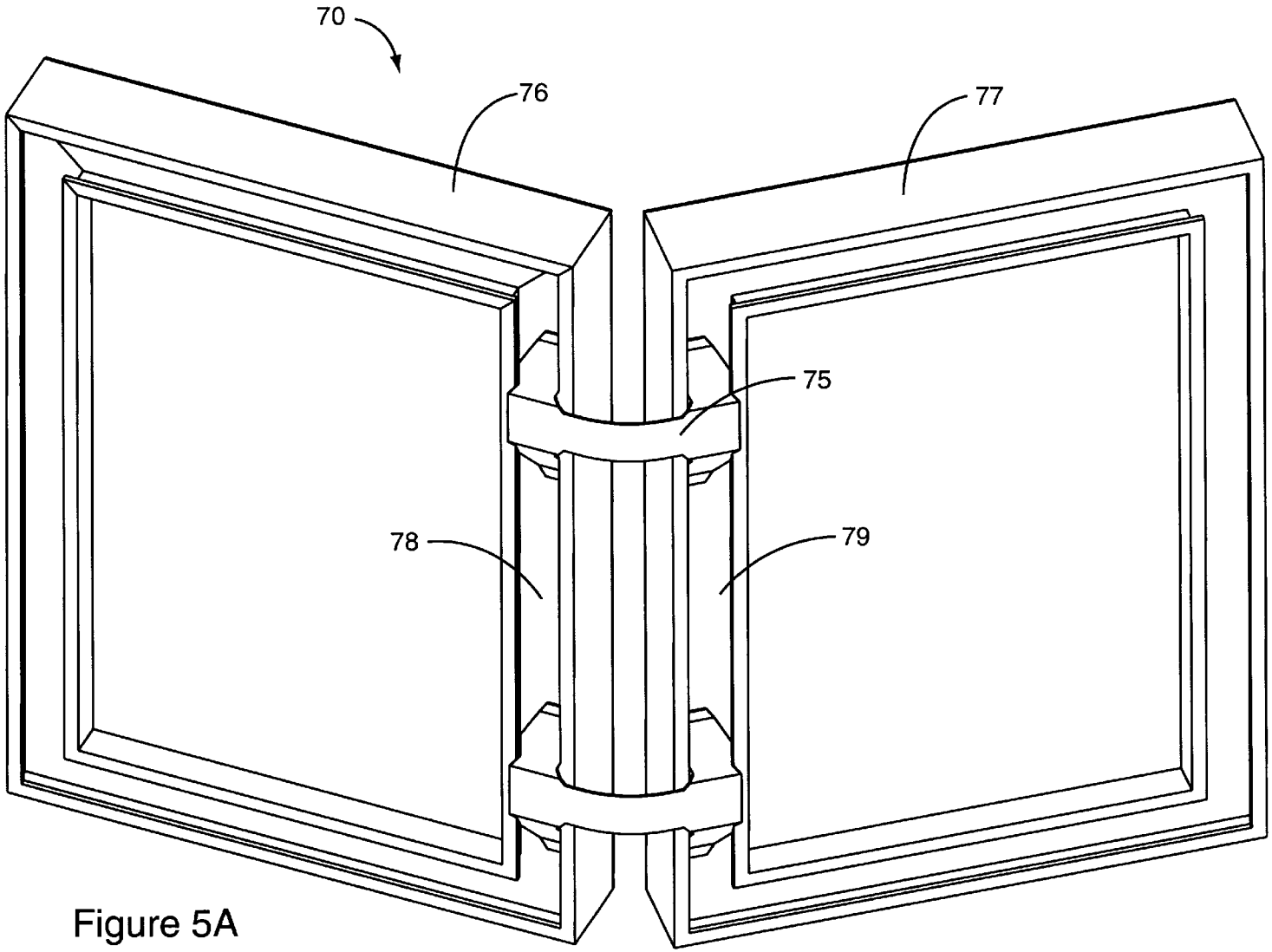
FIG. 5*a* is a diagrammatic back perspective view of a conventional channel backed metal picture frame that utilizes a wedge connecting support in accordance with one aspect of the present invention.
Figure 5B:
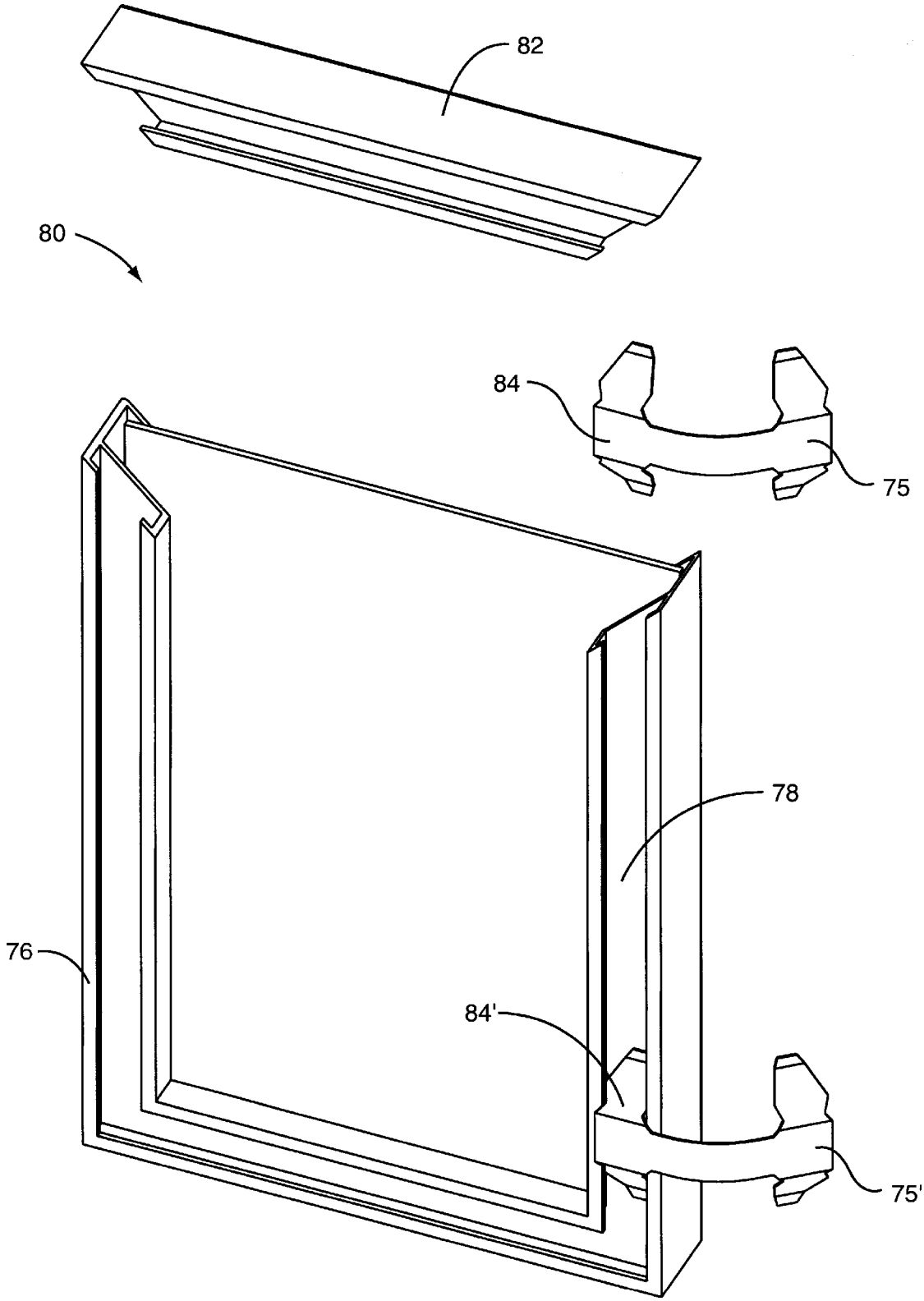
FIG. 5*b* is a diagrammatic back perspective view of a conventional channel backed metal picture frame that illustrates how a wedge connecting support may be inserted in accordance with one aspect of the invention.
Figure 6:
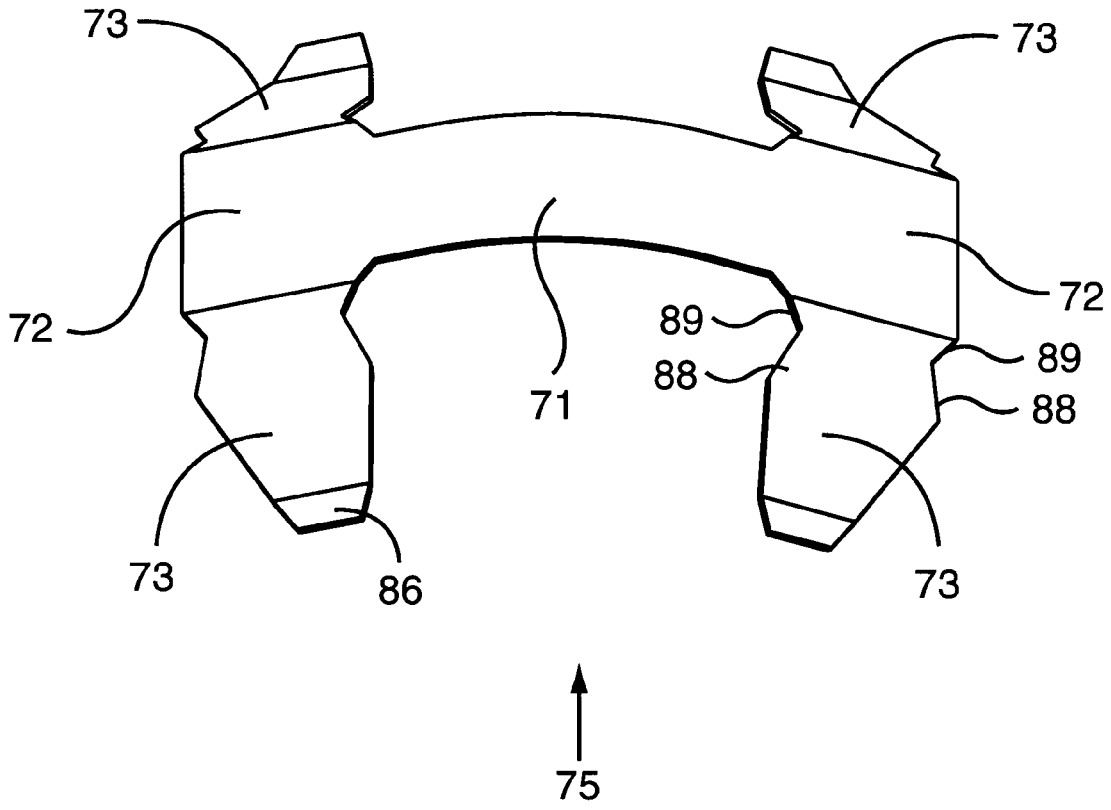
FIG. 6 is a diagrammatic top view of a wedge support member in accordance with one embodiment of the present invention.

Referring next to FIGS. 5*a*, 5*b* and 6, another alternative support arm arrangement 70 is illustrated. In this embodiment the slider member based coupling mechanism (as illustrated in FIGS. 1 and 2*a*) is replaced by a wedge based coupling mechanism. FIG. 5*a* shows two metal picture frames 76 and 77 connected by a wedge frame support 75. The wedge frame support 75 connects pictures frames 76 and 77 by way of their respective channels 78 and 79.

FIG. 5*b* shows a technique 80 for how a wedge frame support 75 may be inserted into the channel 78 of a metal picture frame 76. In FIG. 5*b*, the top portion 82 of frame 76 has been removed. The frame support 75 has a coupling member 84 at one end which may now be inserted into the channel 78. Shown inserted into the channel is a frame support 75' having a coupling member 84' which is now wedged into the channel 78.

FIG. 6 shows in detail the structure of a wedge frame support. Wedge frame support 75 includes a support arm 71 that extends transversely between coupling members 72. The support arm 71 may also attach at any angle to the coupling members 72. Each coupling member 72 has curved arms 73 extending downward that may be slid into the channel of a metal frame or the like to couple the support arm arrangement to the frames. Each arm 73 includes a foot portion 86 that comes into contact with the bottom of the channel, and elbow portions 88 that protrude slightly from the arm 73 so as to come into contact with the inside portions of the lips of the channel. Each arm 73 also has notches 89 for receiving the lips of the channel and allow the wedge frame support to be slid into the channel. In this fashion, the feet 86 push against the bottom of the channel and the elbows 88 push against the underside of the lips, thus wedging the wedge frame support 75 into the channel of a metal picture frame.

The actual geometry, size and spacing of the coupling members 72, the support arm 71, and the curved arms 73 may be widely varied depending upon the nature of the channel of a frame. The wedge frame support 75 may be formed from any suitable material. By way of example, metal has been found to work well. Similarly, when metal or other hard materials are used, the support arm may be coated with a protective coating to reduce its abrasive properties and to improve its appearance.

Figure 7:
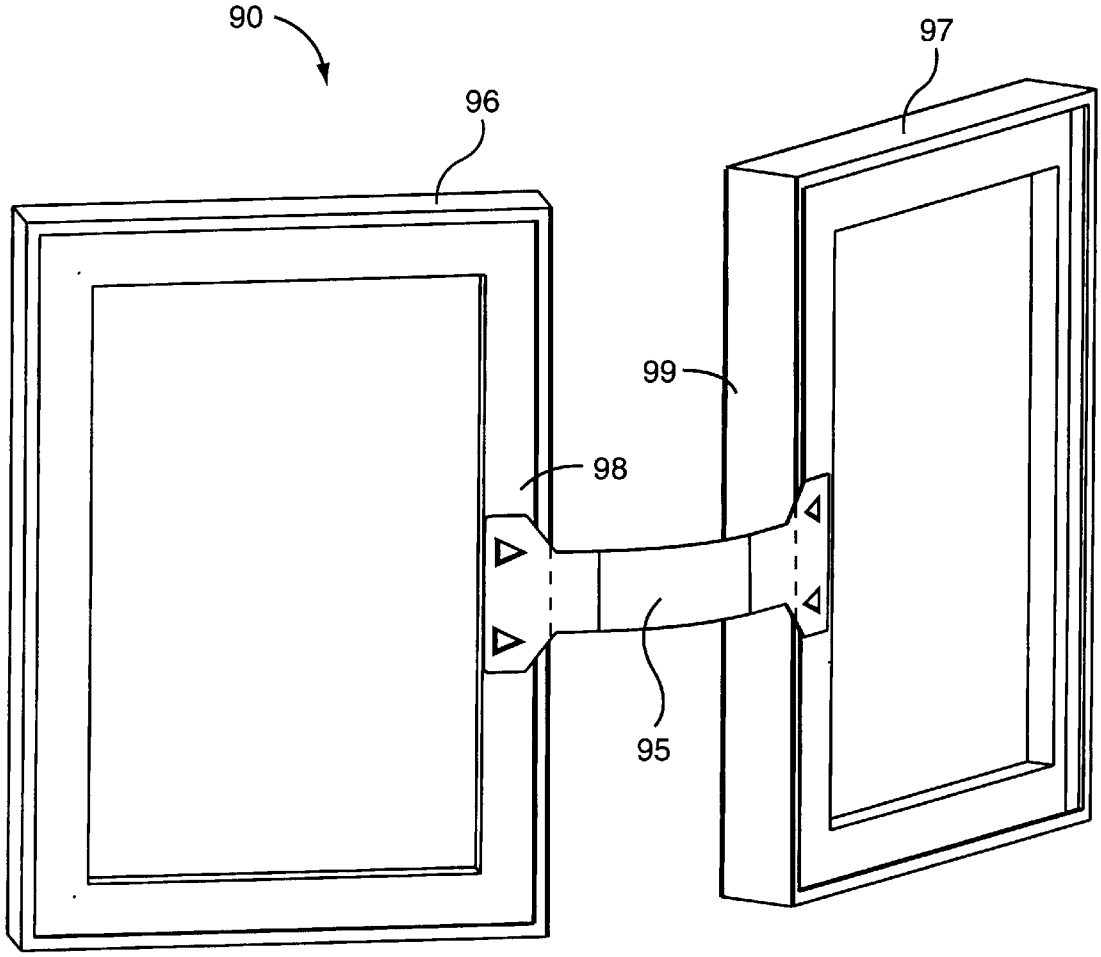
FIG. 7 is a diagrammatic back perspective view of a conventional wood frame that utilizes a spike connecting support in accordance with one aspect of the present invention.
Figure 8B:
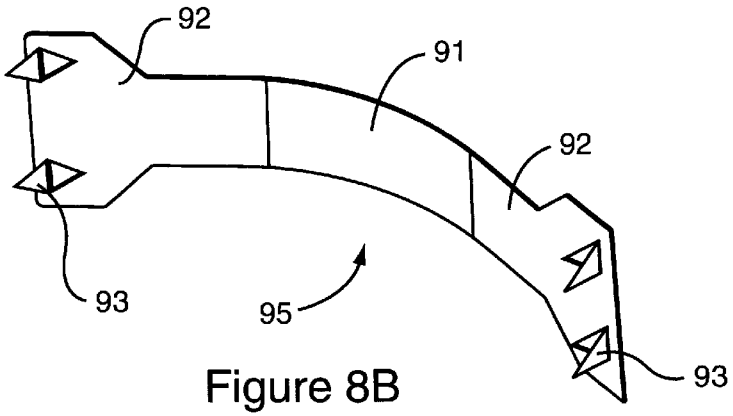
FIGS. 8*a*, 8*b*, 8*c* and 8*d* are diagrammatic top, side and end views of a spike support member in accordance with another embodiment of the present invention.
Figure 8D:
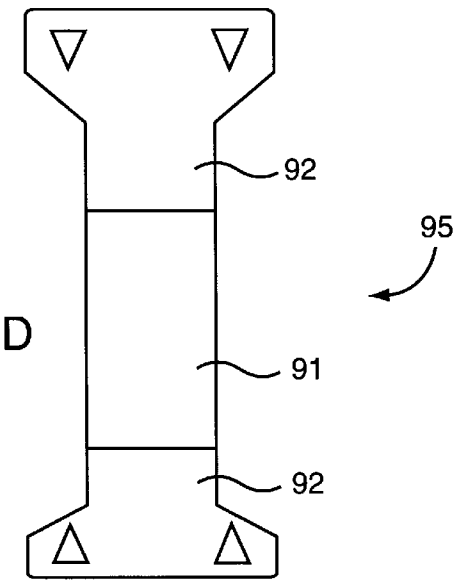
Figure 8A:
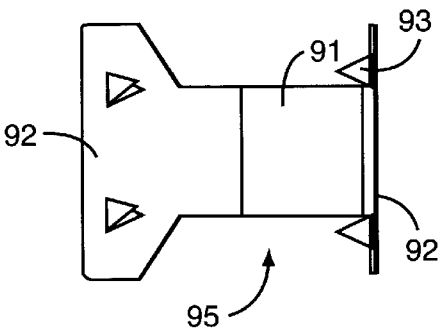
Figure 8C:
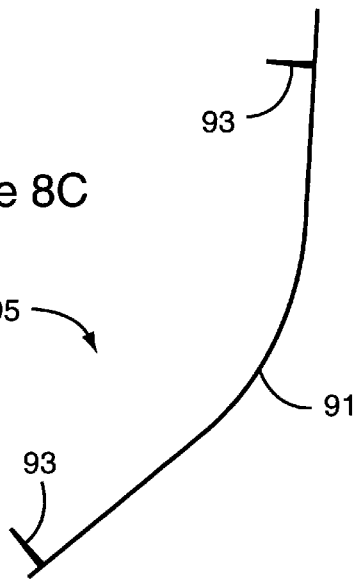

Referring next to FIG. 7 and FIGS. 8*a*–8*d* another alternative support arm arrangement 90 is illustrated. In this embodiment the slider member based coupling mechanism (as illustrated in FIGS. 1 & 2*a*) is replaced by a spike based coupling mechanism for attaching to wood frames for the like. FIG. 7 shows a spike frame support 95 connecting a picture frame 96 to a picture frame 97. The spike frame support is attached to each frame by way of spikes driven into the back edges 98 and 99 of respective frames 96 and 97. Alternatively, it is possible to drive the spikes into the sides of the frames.

FIGS. 8*a* through 8*d* show in more detail different views of a spike frame support 95. The spike frame support 95 includes a support arm 91 which extends transversely from coupling members 92. The support arm 91 may also attach at any angle to the coupling members 92. Each coupling member 92 has at least one spike that may be driven into a wooden frame or the like in order to couple the support arm arrangement to the frames. The actual geometry, size and spacing of the coupling members 92, the support arm 91 and the spikes 93 may be widely varied. The spike frame support 95 can be formed from any suitable material. Metal has been found to work well. Similarly, when metal or other hard materials are used, the support arm may be coated with a protective coating to reduce abrasive properties and to improve appearance.

Figure 9:
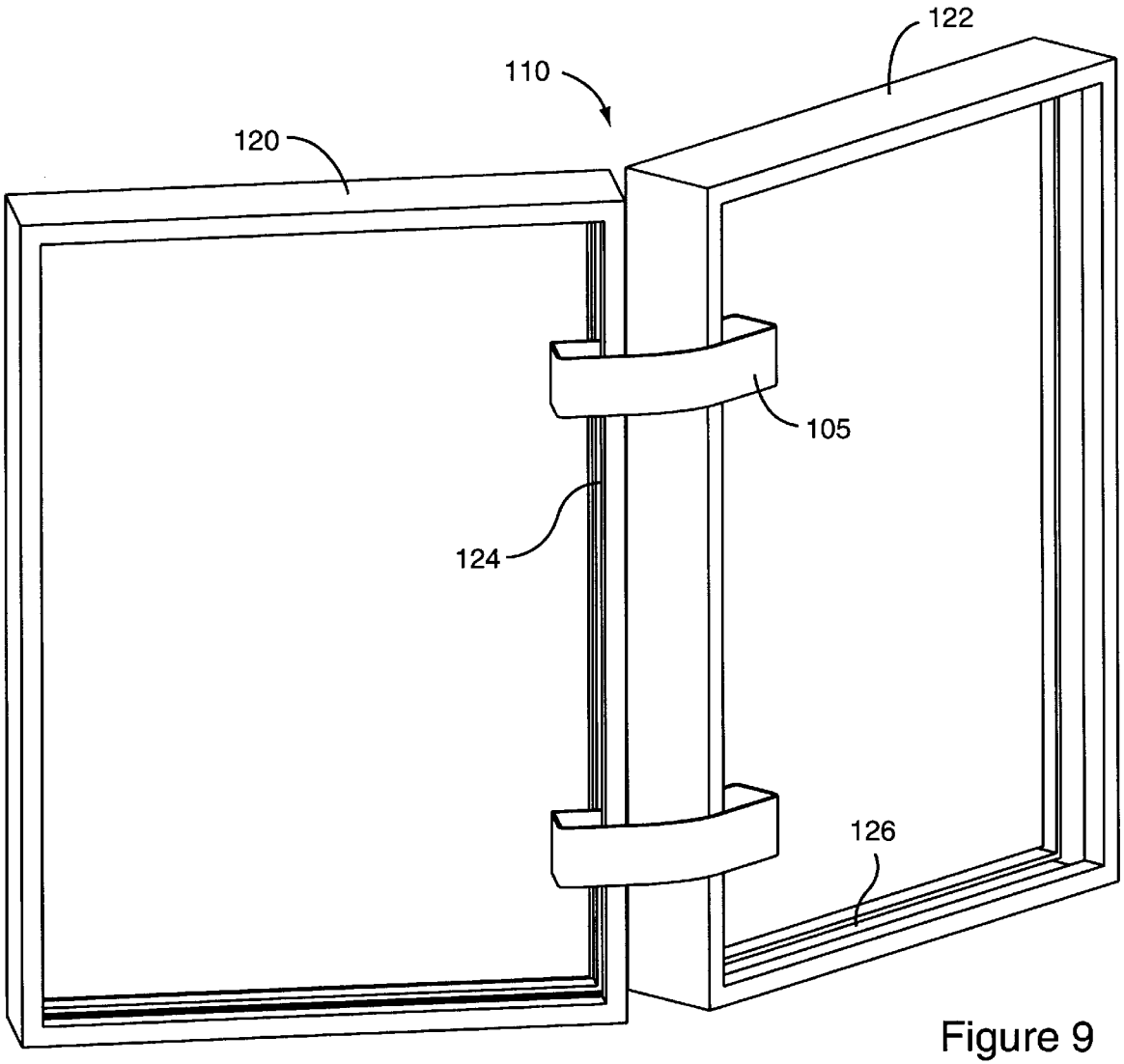
FIG. 9 is a diagrammatic back perspective view of a back loader metal picture frame that utilizes a spring connecting support in accordance with one aspect of the present invention.
Figure 10:
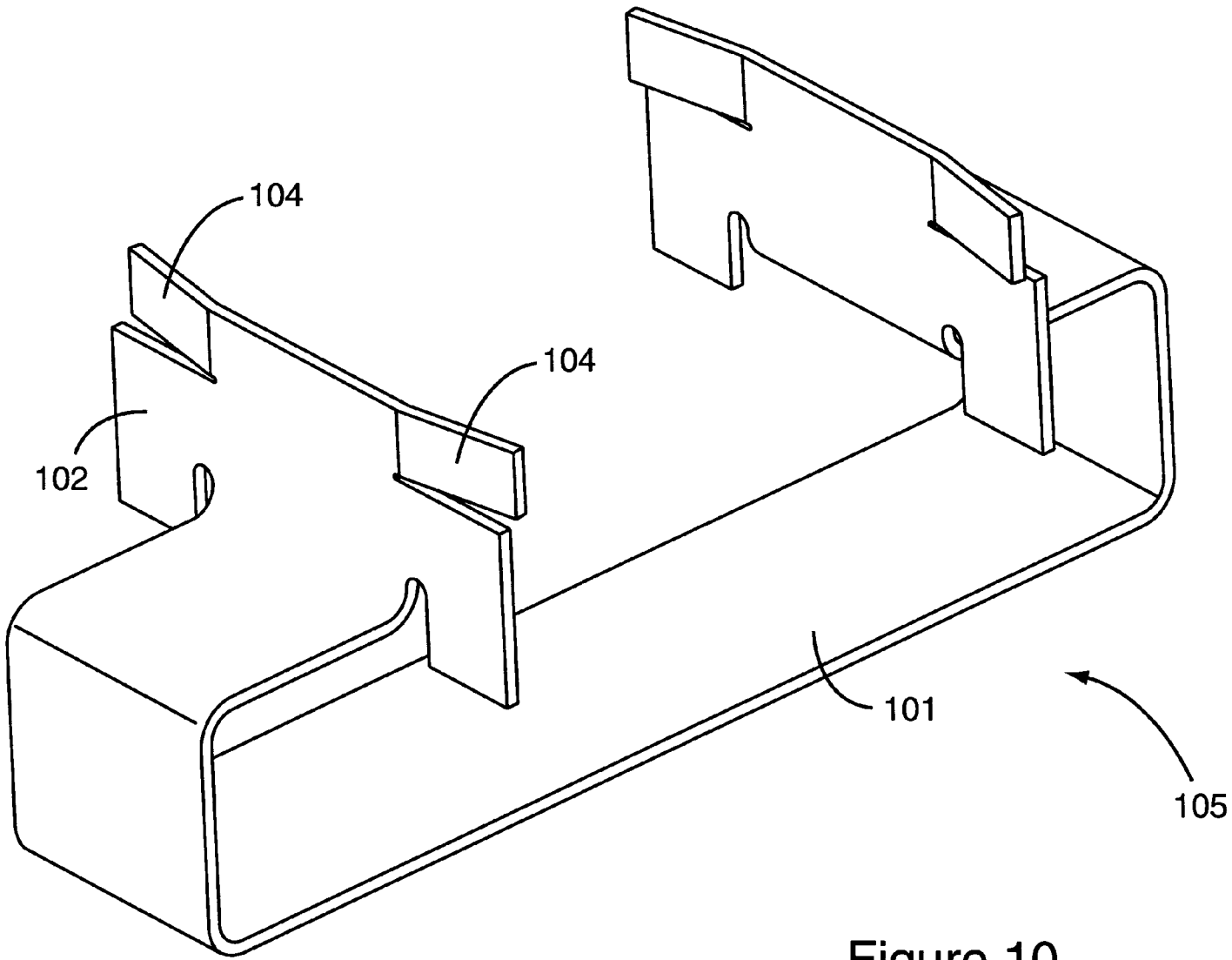
FIG. 10 is a diagrammatic side perspective of a spring support member in accordance with one embodiment of the present invention.
Figure 11:
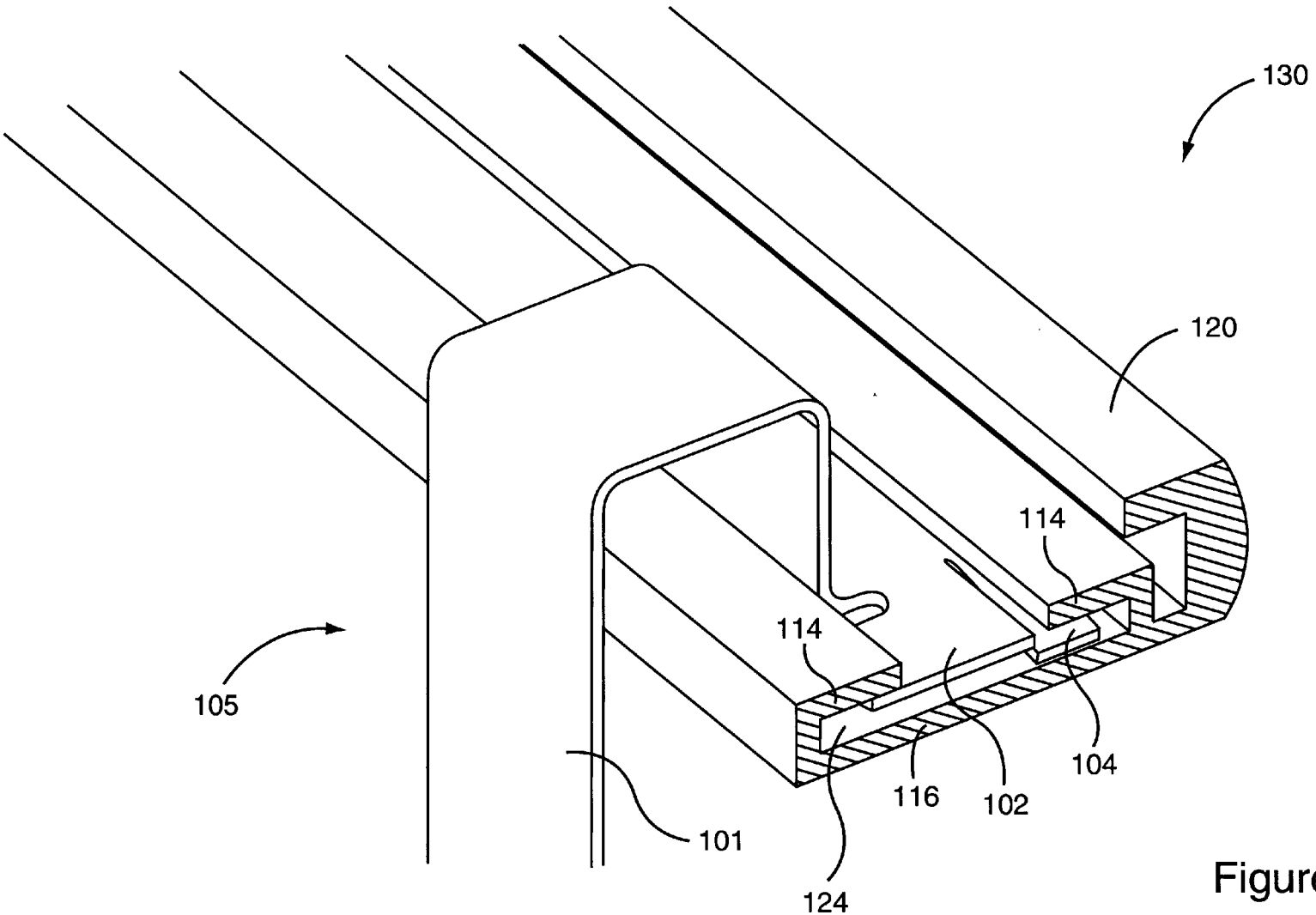
FIG. 11 is a diagrammatic side perspective of a back loader metal picture frame channel utilizing a connecting spring support in accordance with one aspect of the present invention.

Referring next to FIGS. 9, 10 and 11, another alternative support arm arrangement 110 is illustrated. In this embodiment a spring based coupling mechanism is used. This spring frame support is advantageous when using a standard metal frame as shown in FIG. 11, as opposed to the back-loader type frame as shown in FIG. 2*b*. FIG. 9 shows two picture frames 120 and 122 connected by a spring frame support 105. Spring frame support 105 attaches the two frames by way of coupling to their respective channels 124 and 126.

FIG. 10 shows in detail one embodiment of a spring frame support 105. Spring frame support 105 has a support arm 101 connecting two slider members 102. Each slider member 102 has at least one finger 104 which is bent at an angle from the plane of the slider member. These fingers 104 act as springs when slid into the channel of a frame, thus holding the frame support securely in the channel.

FIG. 11 shows in detail 130 how a spring frame support 105 may be inserted into the channel 124 of a metal picture frame 120 in order to hold the spring frame support in place. In particular, the spring-like fingers 104 of the slider member 102 are bent towards the plane of the slider member in order to insert the support into the channel. As such, they are biased in one direction and provide an opposite force to press themselves firmly against the web 116 of the channel 124, at the same time forcing the slider member 102 up against the underside of the lips 114 of the channel 124. Thus, the support is held in place due to friction. It should be appreciated that other ways for forming spring-like fingers from a slider member are possible. Also, the spring frame support may be sized such that can be inserted into the channel of a frame without having to disassemble the picture frame.

Figure 12:
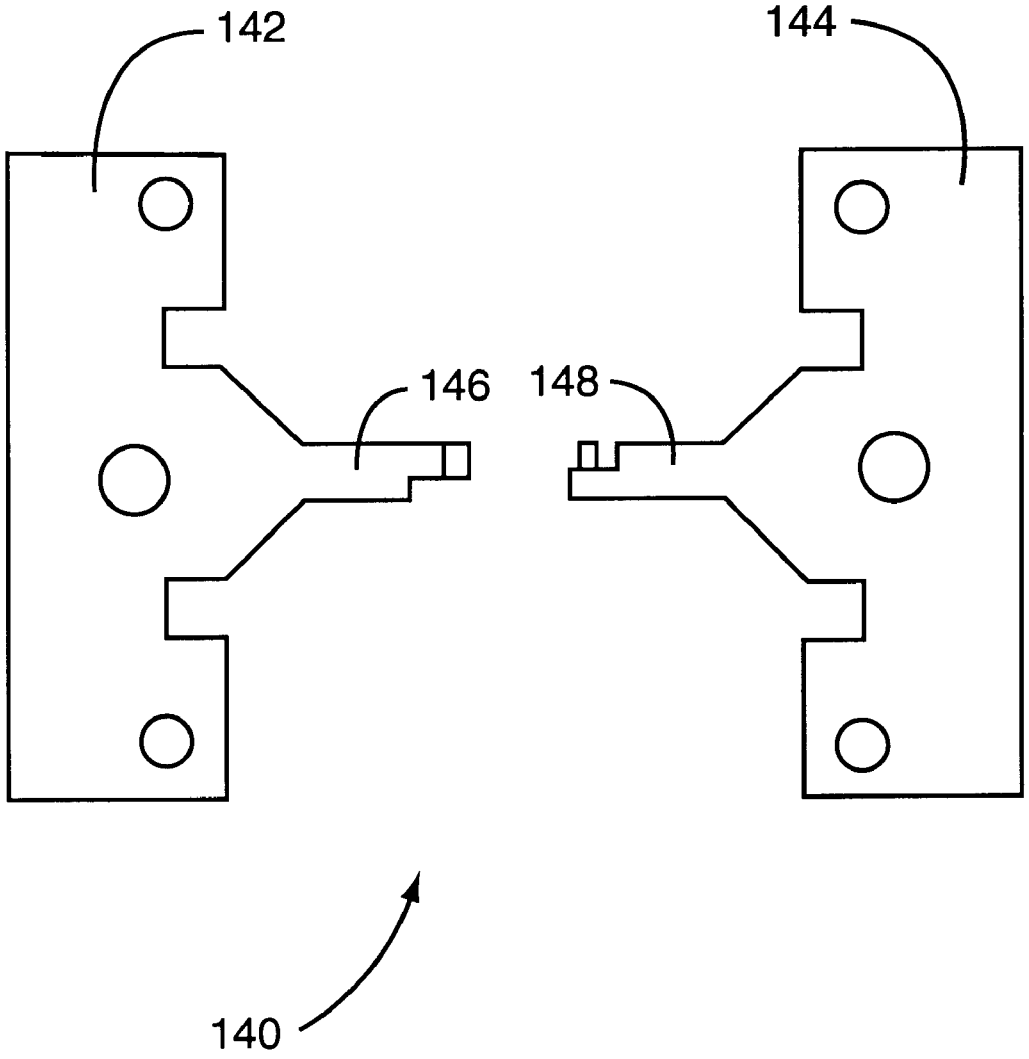
FIG. 12 is a diagrammatic side view of a hinge support member in accordance with one embodiment of the invention.

FIG. 12 shows another embodiment of how a support arm of a frame support 140 may be formed. In this example, frame support 140 includes coupling members 142 and 144 that are similar to the slider coupling members as shown in FIG. 2*a*. However, it should be appreciated that the embodiment of a support arm as shown in FIG. 12 may be used with any of the coupling members described herein. In this embodiment, a support arm takes the form of a hinge that has two sections 146 and 148. Female section 146 is attached to coupling member 142 and male section 148 is attached to coupling member 144. Together, sections 146 and 148 form a hinge that serves as a support arm for the frame support 140. This arrangement is advantageous because sections 146 and 148 may be formed long enough so that when attached to two frames the frames are separated and may be bent in either a forward or a backward direction, unlike standard swivel hinges. Also, sections 146 and 148 are relatively thin, compared to the size of members 142 and 144, thus presenting a more pleasing appearance when viewed between two frames, unlike standard full-size swivel hinges. Any other form of hinge may also serve as a support arm for any of the frame supports described herein. In one embodiment, the hinge may be stiffened by making the male section oversized, or by deforming the hinge slightly in order to provide a more rigid support arm.

Although only a few embodiments of the present invention have been described in detail, it should be understood that the present invention may be embodied in many other specific forms without departing from the spirit or scope of the invention. Particularly, the materials from which the support rail and/or the frame support are formed may be widely varied. Of course, the size of the components may also be varied in accordance with the needs of a particular frame. Also, various support arm arrangements with coupling mechanisms have been described in detail. They include the slider frame support, the snap frame support, the wedge frame support, and the spring frame support. Also, various techniques for attaching to a wood frame have been described, including using screws, studs, nails, spikes, glue, etc. A variety of equivalent coupling mechanisms may be used in their place. In addition, a frame support may utilize a different coupling mechanism one each end of its support arm. For example, a frame support may have a slider coupling member on one end and a spike coupling member on the other. Or two metal frames may be attached by using a wedge coupling member on one end of a frame support and a snap coupling member on the other. Also wood frames may be connected to metal frames using various of the coupling members described herein. Any of the described coupling members may be used with any of the other members on a particular support arm.

Frequent reference has been made to the support of picture frames. It should be appreciated that within the context of this description, the term picture frame is intended to be a generic term that includes picture frames of any type including wooden, metallic, plastic, glass, cardboard and other types, as well as mount boards, mats and plaques. In addition, the various coupling members may also attach to the sides of a picture frame in addition the back of a frame. The coupling members may also be sized so that they may be inserted into the channel of a metal frame without having to disassemble the metal frame.

Therefore, the present examples are to be considered as illustrative and not restrictive, and the invention is not to be limited to the details given herein, but may be modified within the scope of the appended claims.

I claim:

1. An arrangement comprising a first and a second picture frame, each of said picture frames having a rear face and side edge, and a picture frame connector for connecting the first and second picture frames together, the picture frame connector including:

a rigid support arm that is malleable;

a first coupling member rigidly attached to a first end of said support arm, said first coupling member having a first slot open at one end through which a fastener is inserted for attaching said first coupling member to the rear face of said first picture frame, whereby said picture frame connector may be disengaged from said first picture frame without completely removing said fastener from said first picture frame; and a second coupling member rigidly attached to a second end of said support arm, said second coupling member having a second slot open at one end through which a fastener is inserted for attaching said second coupling member to the rear face of said second picture frame, whereby said picture frame connector holds said first and second picture frames in a stable position relative to one another and said picture frame connector may be bent to change the position of said first picture frame relative to said second picture frame.

2. An arrangement comprising a first metal picture frame including a first outwardly facing channel having a first undercut constricted channel opening with inward confining lips said lips of said first undercut constricted channel opening facing one another, and a second metal picture frame including a second outwardly facing channel having a second undercut constricted channel opening with inward confining lips said lips of said second undercut constricted channel opening facing one another together, and a picture frame connector for connecting the first and second picture frames together, said picture frame connector comprising:

a one piece rigid support arm that is malleable;

a first coupling member rigidly attached to a first end of said support arm, said first coupling member having first attaching means for securely attaching said first coupling member to said first outwardly facing channel of said first metal picture frame, said first attaching means being slidable and engaging against the inward confining lips of said first outwardly facing channel of said first metal picture frame and may be inserted in said first outwardly facing channel through the first undercut constricted channel opening without disassembly of said first metal picture frame; and a second coupling member rigidly attached to a second end of said support arm, said second coupling member having second attaching means for securely attaching said second coupling member to said second outwardly facing channel of said second metal picture frame, said second attaching means being slidable and engaging against the inward confining lips of said second outwardly facing channel of said second metal picture frame and may be inserted in said second outwardly facing channel through the second undercut constricted channel opening without disassembly of said second metal picture frame, whereby said picture frame connector holds said first and second picture frames in a stable position relative to one another and said picture frame connector may be bent to change the position of said first metal picture frame relative to said second metal picture frame.

3. An arrangement as recited in claim 2 wherein said first attaching means has a relatively flat shape and is sized so as to slide within said first outwardly facing channel of said first metal picture frame, said first attaching means including a threaded hole through which a screw may be inserted and tightened in order to secure said first attaching means to said first picture frame made of metal.

4. An arrangement connector as recited in claim 2 wherein said first attaching means includes spring-like fingers arranged to secure said first attaching means within said first outwardly facing channel of said first metal picture frame.

5. An arrangement connector as recited in claim 2 wherein said first attaching means includes a snap-based mechanism arranged to secure said first attaching means within said first outwardly facing channel of said first metal picture frame.

6. An arrangement connector as recited in claim 2 wherein said first attaching means includes a wedge member arranged to secure said first attaching means within said first outwardly facing channel of said first metal picture frame.

7. An arrangement comprising a first picture frame, a second picture frame and a sliding picture frame connector for connecting the first and second picture frames together, each of said picture frames having a rear face and side edge, said sliding picture frame connector comprising:

a one piece rigid support arm that is malleable;

a first sliding member rigidly attached to a first end of said support arm, said first sliding member sized so as to slide and engage against inward confining lips of a first undercut constricted channel opening of a first outwardly facing channel of said first picture frame said lips of said first undercut constricted channel opening facing one another, and first sliding member being able to be inserted in said first outwardly facing channel without disassembly of said first picture frame, said first sliding member having first attaching means for attaching said first sliding member to said first picture frame; and a second sliding member rigidly attached to a second end of said support arm, said second sliding member sized so as to slide and engage against inward confining lips of a second undercut constricted channel opening of a second outwardly facing channel of said second picture frame said lips of said second undercut constricted channel opening facing one another, said second sliding member being able to be inserted in said second outwardly facing channel without disassembly of said second picture frame, said second sliding member having second attaching means for attaching said second sliding member to said second picture frame, whereby said picture frame connector holds said first and second picture frames in a stable position relative to one another and said picture frame connector may be bent to change the position of said first picture frame relative to said second picture frame.

8. An arrangement as recited in claim 7 wherein said first attaching means of said first sliding member includes at least one fastener hole through which a fastener may be inserted to secure said first sliding member to a wooden picture frame.

9. An arrangement as recited in claim 8 wherein said first attaching means of said first sliding member further includes a threaded hole through which a screw may be inserted and tightened in order to secure said first sliding member to a metal picture frame.

10. An arrangement as recited in claim 7 wherein said first attaching means of said first sliding member includes at least one slot through which a fastener is inserted to secure said first sliding member to a wooden picture frame, whereby said picture frame connector may be disengaged from said wooden picture frame without completely removing said fastener from said first wooden picture frame.

11. An arrangement as recited in claim 10 wherein said first attaching means of said first sliding member further includes a threaded hole through which a screw may be inserted and tightened in order to secure said first sliding member to a metal picture frame.

12. An apparatus comprising:

a first picture frame;

a second picture frame;

a picture frame connector for rigidly connecting said first picture frame to said second picture frame, said picture frame connector including a support arm, a first coupling means rigidly attached to a first end of said support arm and rigidly attaching said picture frame connector to said first picture frame, said first coupling means including an open-ended slot through which a fastener is inserted for attaching said first coupling means to a rear face of said first picture frame, whereby said picture frame connector may be disengaged from said first picture frame without completely removing said fastener from said first picture frame, a second coupling means rigidly attached to a second end of said support arm and rigidly attaching said picture frame connector to said second picture frame, whereby said first and second picture frames are rigidly supported by said picture frame connector such that said picture frame connector may be bent to change the relative position of said first picture frame to said second picture frame.

13. An apparatus as recited in claim 12 comprising a plurality of picture frames and a plurality of picture frame connectors, each of said picture frame connectors connecting two of said plurality of picture frames together such that said picture frames may be arranged in any number of positions relative to one another.

* * * * *